US008896504B2

(12) United States Patent
Park et al.

(10) Patent No.: US 8,896,504 B2
(45) Date of Patent: Nov. 25, 2014

(54) ORGANIC LIGHT EMITTING DISPLAY AND METHOD OF DRIVING THE SAME

(75) Inventors: Sung-Un Park, Yongin (KR); Sung-Cheon Park, Yongin (KR); Wook Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 1066 days.

(21) Appl. No.: 12/784,457

(22) Filed: May 20, 2010

(65) Prior Publication Data

US 2011/0025670 A1 Feb. 3, 2011

(30) Foreign Application Priority Data

Aug. 3, 2009 (KR) ..... 10-2009-0071274

(51) Int. Cl.
*G09G 3/30* (2006.01)
*G09G 3/32* (2006.01)

(52) U.S. Cl.
CPC ..... *G09G 3/3233* (2013.01); *G09G 2330/022* (2013.01); *G09G 2310/0297* (2013.01)
USPC ..... 345/76

(58) Field of Classification Search
USPC ..... 345/36, 39, 45, 46, 76–80, 82, 83, 89, 345/98, 211; 315/169.1–169.3
See application file for complete search history.

(56) References Cited

U.S. PATENT DOCUMENTS

2002/0180673 A1 12/2002 Tsuda et al.
2002/0195964 A1* 12/2002 Yumoto ..... 315/169.3
2003/0058232 A1* 3/2003 Washio et al. ..... 345/204
2004/0036669 A1 2/2004 Yanagi et al.
2005/0237280 A1* 10/2005 Oh et al. ..... 345/76
2005/0264499 A1* 12/2005 Kim et al. ..... 345/76
2006/0022929 A1 2/2006 Hashimoto et al.
2006/0097974 A1 5/2006 Hashimoto et al.
2006/0103611 A1* 5/2006 Choi ..... 345/82
2006/0107143 A1* 5/2006 Kim et al. ..... 714/726
2007/0063959 A1 3/2007 Iwabuchi et al.

(Continued)

FOREIGN PATENT DOCUMENTS

CN 1420482 A 5/2003
CN 1440514 A 9/2003

(Continued)

OTHER PUBLICATIONS

Japanese Office action dated Jun. 5, 2012, for corresponding Japanese Patent application 2010-036088, (2 pages).

(Continued)

*Primary Examiner* — Pegeman Karimi
(74) *Attorney, Agent, or Firm* — Christie, Parker & Hale, LLP

(57) ABSTRACT

An organic light emitting display capable of reducing power consumption in a standby mode to increase the use time of a battery and a method of driving the same. The organic light emitting display includes a pixel unit for displaying an image by utilizing a plurality of frames and in accordance with data signals and scan signals; a data driver for outputting the data signals; a scan driver for outputting the scan signals; and a controller for controlling the data driver and the scan driver so that, in at least one frame of the plurality of frames, the scan signals are not transmitted to the pixel unit.

18 Claims, 4 Drawing Sheets

(56) References Cited

U.S. PATENT DOCUMENTS

| | | | | |
|---|---|---|---|---|
| 2007/0126686 | A1* | 6/2007 | Chang et al. | 345/98 |
| 2008/0231562 | A1* | 9/2008 | Kwon | 345/77 |
| 2009/0106665 | A1* | 4/2009 | Jeong et al. | 715/748 |
| 2009/0167648 | A1 | 7/2009 | Jeon et al. | |
| 2009/0174634 | A1 | 7/2009 | Kohno | |
| 2010/0053143 | A1* | 3/2010 | Liu | 345/211 |

FOREIGN PATENT DOCUMENTS

| | | | |
|---|---|---|---|
| CN | 1485806 | A | 3/2004 |
| CN | 1728230 | A | 2/2006 |
| CN | 1783173 | A | 6/2006 |
| EP | 1 391 871 | A1 | 2/2004 |
| JP | 2002-169499 | | 6/2002 |
| JP | 2003-316315 | | 11/2003 |
| JP | 2005-107004 | | 4/2005 |
| JP | 2007-248653 | A | 9/2007 |
| JP | 2008-203826 | | 9/2008 |
| JP | 2008-225415 | | 9/2008 |
| KR | 1020020045442 | | 6/2002 |
| KR | 1020030065535 | | 8/2003 |
| KR | 1020070026441 | | 3/2007 |
| KR | 10-2009-0070370 | A | 7/2009 |

OTHER PUBLICATIONS

SIPO Office action dated Sep. 7, 2012 for Chinese Patent Application No. CN 201010223386.4 (6 pages).

Extended European Search Report dated Oct. 4, 2010 issued in corresponding EP Application No. 10251386.8, listing the cited references in this IDS (11 pages).

KIPO Office Action for corresponding Korean Priority Patent Application No. 10-2009-0071274, dated Oct. 28, 2011, 2 pages.

KIPO Office Action for corresponding Korean Priority Patent Application No. 10-2009-0071274, dated Dec. 2, 2011, 3 pages.

Office action dated Feb. 21, 2012 for corresponding Japanese Patent Application No. 2010-036088; 3pp.

SIPO Office action dated Feb. 14, 2011 in priority Korean patent application No. KR 10-2009-0071274, 4 pps.

SIPO Office action dated Jan. 29, 2014, with English translation, for corresponding Chinese Patent application 201010223386.4, (5 pages).

* cited by examiner

ORGANIC LIGHT EMITTING DISPLAY AND METHOD OF DRIVING THE SAME

CROSS-REFERENCE TO RELATED APPLICATION

This application claims priority to and the benefit of Korean Patent Application No. 10-2009-0071274, filed on Aug. 3, 2009, in the Korean Intellectual Property Office, the entire content of which is incorporated herein by reference.

BACKGROUND

1. Field

An embodiment of the present invention relates to an organic light emitting display and a method of driving the same.

2. Description of the Related Art

Various flat panel displays (FPD) that are lighter in weight and smaller in volume than comparable cathode ray tube (CRT) displays are being developed. Non-limiting examples of these FPDs include a liquid crystal display (LCD), a field emission display (FED), a plasma display panel (PDP), and an organic light emitting display.

Among the FPDs, the organic light emitting display displays an image using organic light emitting diodes (OLED) that generate light by re-combination of electrons and holes generated to correspond to the flow of current.

The organic light emitting display is widely utilized in a personal digital assistant (PDA), an MP3 player, and/or a mobile telephone due to its excellent color reproducibility and small thickness.

FIG. 1 is a block diagram illustrating the structure of an organic light emitting display according to an embodiment of the present invention. Referring to FIG. 1, the organic light emitting display includes a pixel unit (a display region) 10, a data driver 20, a scan driver 30, and a controller 40.

A plurality of pixels 11 are arranged in the pixel unit 10 and each of the pixels 11 includes an organic light emitting diode (OLED) that emits light to correspond to the flow of current therein. The pixel unit 10 includes n scan lines S1, S2, . . . , Sn−1, and Sn formed to extend in a first direction (a row direction) and to transmit scan signals, and m data lines D1, D2, . . . , Dm−1, and Dm formed to extend in a second direction (a column direction) crossing the first direction and to transmit data signals.

In addition, the pixel unit 10 receives a first power of a first power source and a second power of a second power source having a lower voltage level than that of the first power source to be driven. Therefore, in the pixel unit 10, current flows to the OLED by utilizing the scan signals, the data signals, the first power source, and the second power source to emit light and to display an image.

The data driver 20 receives data driver control signals DCS and image signals R, G, B data from the controller 40 to generate the data signals. The data driver 20 is coupled to the data lines D1, D2, . . . , Dm−1, and Dm of the pixel unit 10 to apply the generated data signals to the pixel unit 10.

The scan driver 30 receives scan driver control signals SCS from the controller 40 to generate the scan signals. The scan driver 30 is coupled to the scan lines S1, S2, . . . , Sn−1, and Sn to transmit the scan signals to specific rows of the pixel unit 10. The data signal output from the data driver 20 is transmitted to the pixel 11 where the scan signal is transmitted so that the voltage corresponding to the data signal is transmitted to the pixel 11.

The controller 40 controls the data driver 20 and the scan driver 30 so that the pixel unit 10 can display an image.

When the above structured organic light emitting display is used for a mobile telephone, in a standby mode, an image representing date and hour is displayed only on a partial region of the pixel unit and the image is not displayed on the remaining region.

The image is displayed only on the partial region (a partial screen) in order to reduce power consumption and to increase the use time of a battery of the organic light emitting display.

However, in the standby mode, the data driver 20 and the scan driver 30 are driven in the same way. That is, the power consumptions of the data driver 20 and the scan driver 30 do not change in the standby mode. Therefore, in order to reduce power consumption, an improved method of reducing power consumption in the data driver 20 and the scan driver 30 in the standby mode is needed.

SUMMARY OF THE INVENTION

Aspects of embodiments of the present invention are directed toward an organic light emitting display with a relatively small power consumption and a method of using the same.

Aspects of embodiments of the present invention are directed toward an organic light emitting display capable of reducing power consumption in a standby mode to increase the use time of a battery of the display and a method of using the same.

An embodiment of the present invention provides an organic light emitting display, including a pixel unit (display region) for displaying an image by utilizing a plurality of frames and in accordance with data signals and scan signals; a data driver for outputting the data signals; a scan driver for outputting the scan signals; and a controller for controlling the data driver and the scan driver so that, in at least one frame of the plurality of frames, the scan signals are not transmitted to the pixel unit.

In one embodiment, the scan driver is stopped from being driven by the controller during a frame period of the at least one frame when the scan signals are not transmitted.

In one embodiment, the organic light emitting display further includes a demultiplexer between the data driver and the pixel unit to distribute a plurality of data signals output from one output end of the data driver during a frame period of at least an other frame of the plurality of frames. Here, an operation of the demultiplexer may stop in the at least one frame when the scan signals are not transmitted to the pixel unit.

In one embodiment, the image is displayed only in a partial region of the pixel unit.

In one embodiment, the image is a standby image.

Another embodiment of the present invention provides a method of driving an organic light emitting display for displaying an image by utilizing a plurality of frames and in accordance with data signals and scan signals. The method includes: transmitting the data signals to pixels of a pixel unit of the organic light emitting display by the scan signals to display a first image of a first frame of the plurality of frames; and maintaining the data signals transmitted in the first frame in the pixels to display a second image of a second frame of the plurality of frames.

In one embodiment, the scan signals are not transmitted in the second frame.

In one embodiment, the first and second images are displayed only on a part of the pixel unit. The first and second images may be a standby image.

In one embodiment, the second frame is an adjacent frame following the first frame.

In the organic light emitting display and the method of driving the same according to embodiments of the present invention, the scan driver is driven to output the scan signals only in a part of the time where the image is displayed so that power consumption in accordance with the driving of the scan signals can be reduced.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
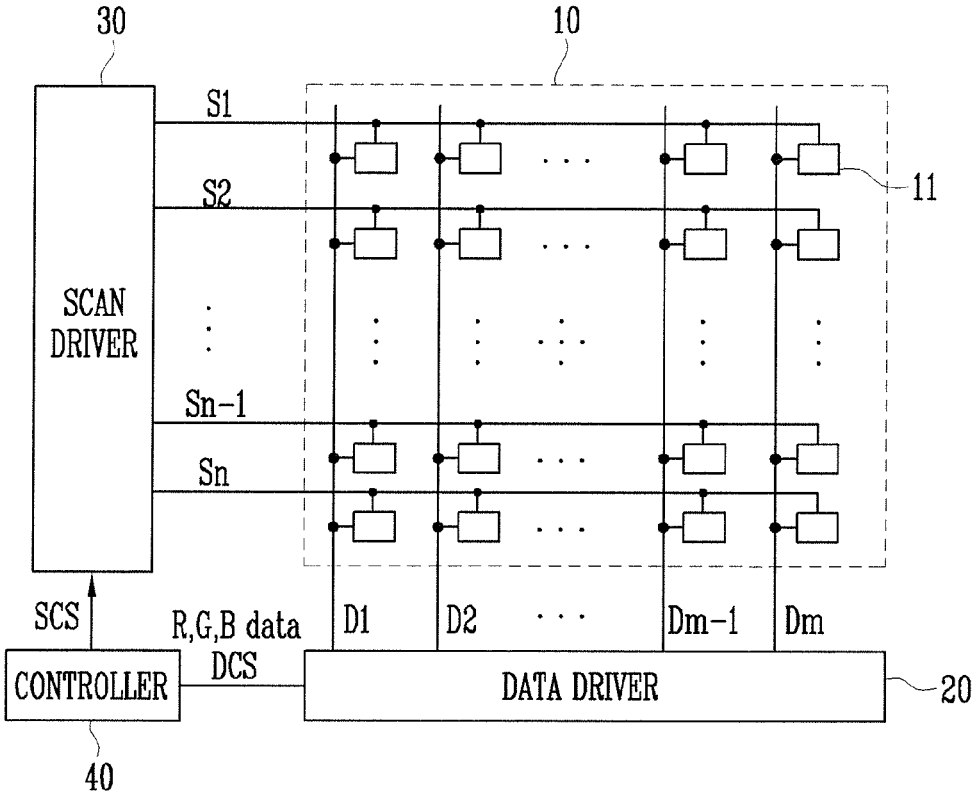
FIG. 1 is a block diagram illustrating the structure of an organic light emitting display.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via one or more third elements. Further, some of the elements that are not essential to the complete understanding of the invention are omitted for clarity. Also, like reference numerals refer to like elements throughout.

Hereinafter, an embodiment of the present invention will be described in detail with reference to the accompanying drawings.

Figure 2:
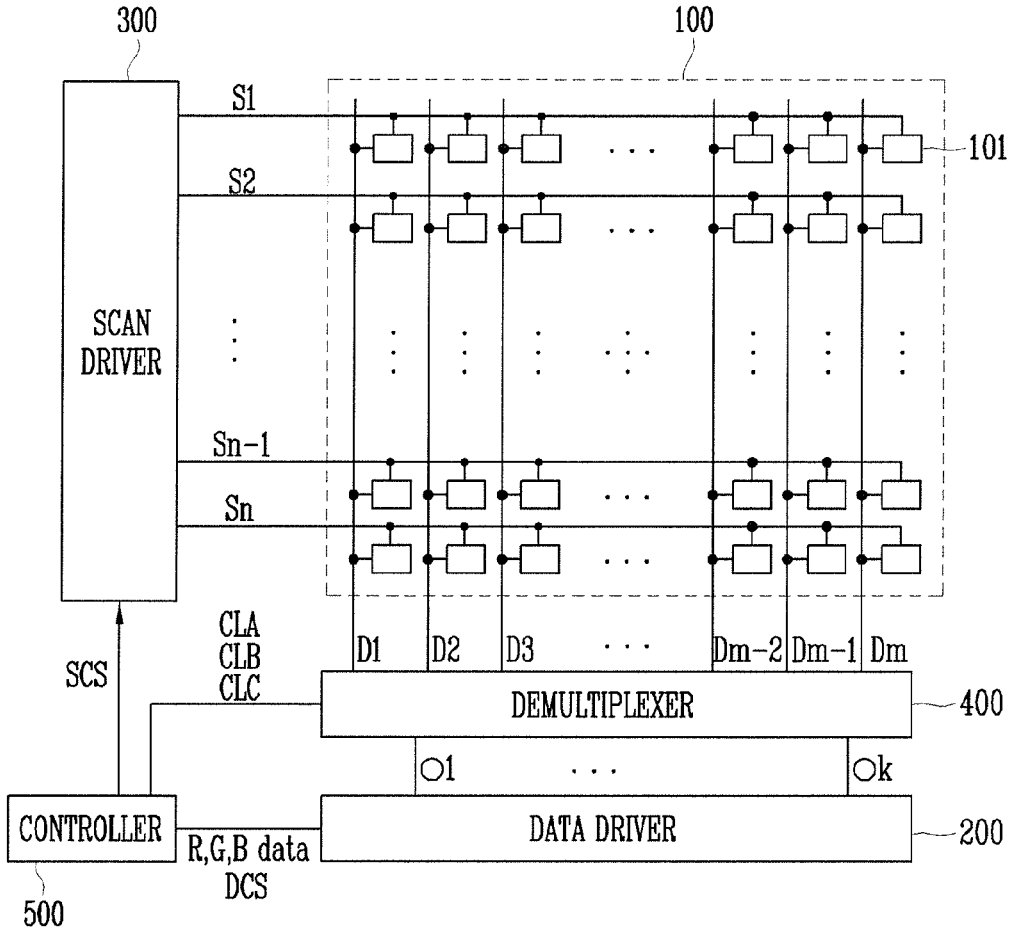
FIG. 2 is a block diagram illustrating the structure of an organic light emitting display according to an embodiment of the present invention.

FIG. 2 is a block diagram illustrating the structure of an organic light emitting display according to the present invention. Referring to FIG. 2, the organic light emitting display includes a pixel unit (display region) 100, a data driver 200, a scan driver 300, a demultiplexer 400, and a controller 500.

A plurality of pixels 101 are arranged in the pixel unit 100, and each of the pixels 101 includes an organic light emitting diode (OLED) that emits light to correspond to the flow of current. The pixel unit 100 includes n scan lines S1, S2, . . . , Sn−1, and Sn formed to extend in a first direction (a row direction) and to transmit scan signals, and m data lines D1, D2, . . . , Dm−1, and Dm formed to extend in a second direction (a column direction) crossing the first direction and to transmit data signals.

In addition, the pixel unit 100 receives a first power of a first power source ELVDD and a second power of a second power source ELVSS having a lower voltage level than the first power source ELVDD to be driven. Therefore, in the pixel unit 100, current flows to the OLED by utilizing the scan signals, the data signals, the first power source ELVDD, and the second power source ELVSS to emit light and to display an image.

The data driver 200 receives data driver control signals DCS and image signals R, G, B data from the controller 500 to generate the data signals. The data driver 200 is coupled to the data lines D1, D2, . . . , Dm−1, and Dm of the pixel unit 100 through the demultiplexer 400 to apply the generated data signals to the pixel unit 100.

The scan driver 300 receives scan driver control signals SCS from the controller 500 to generate the scan signals. The scan driver 300 is coupled to the scan lines S1, S2, . . . , Sn−1, and Sn to transmit the scan signals to specific rows of the pixel unit 100. The data signal output from the data driver 200 is transmitted to the pixel 101 where the scan signal is transmitted so that the voltage corresponding to the data signal is transmitted to the pixel 101.

The demultiplexer 400 transmits the data signals transmitted through the output terminals O1 . . . Ok of the data driver 200 to the data lines D1, D2, . . . , Dm−1, and Dm. In particular, one output terminal is coupled to three data lines through the demultiplexer. One output terminal of the data driver 200 sequentially outputs red, green, and blue data signals. The demultiplexer 400 has the red, green, and blue data signals transmitted to the three data lines by demultiplexer control signals CLA, CLB, and CLC. Therefore, the number of output terminals O1 . . . Ok of the data driver 200 can be reduced by the demultiplexer 400.

The controller 500 transmits the image signals R, G, B data and the data driver control signals DCS to the data driver 200, transmits the scan driver control signals SCS to the scan driver 300, transmits demultiplexer control signals CLA, CLB, and CLC to the demultiplexer 400, and has the data driver 200 select transmitted data signals so that the pixel unit 100 can display an image.

Figure 3:
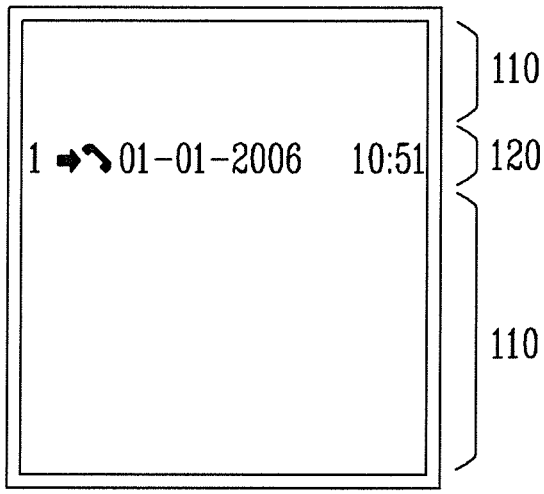
FIG. 3 is a view illustrating an image displayed on the pixel unit of the organic light emitting display of FIG. 2 in a standby mode.

FIG. 3 is a view illustrating an image displayed on the pixel unit of the organic light emitting display of FIG. 2 in a standby mode. Referring to FIG. 3, the organic light emitting display is driven in a display mode where images such as a moving picture and a photograph are displayed and in a standby mode where only date and hour are displayed.

In order to reduce power consumption in the standby mode, the pixel unit is divided into a non-display region 110 and a display region 120. In the display region 120, icons such as date and hour are displayed. The non-display region 110 does not emit light so that the non-display region 110 is displayed black (displays no emitting light).

Since the organic light emitting display displays an image corresponding to the current that flows to each pixel, current flows to the pixels positioned in the display region 120 in the standby mode and current does not flow to the pixels positioned in the non-display region 110. That is, the amount of the current that flows to the pixel unit 100 in the standby mode is smaller than the amount of the current that flows to the pixel unit in the display mode. Therefore, power consumption is reduced.

However, in the case where the image is displayed only in the display region 120 that is not the entire region of the pixel unit 100 but is a part of the pixel unit 100, the scan driver 300 performs the same operation as when the scan driver 300 operates in the display mode. Therefore, in order to effectively reduce power consumption, the scan signals input to the pixel unit 100 are to be differently transmitted in the display mode and in the standby mode.

Figure 4:
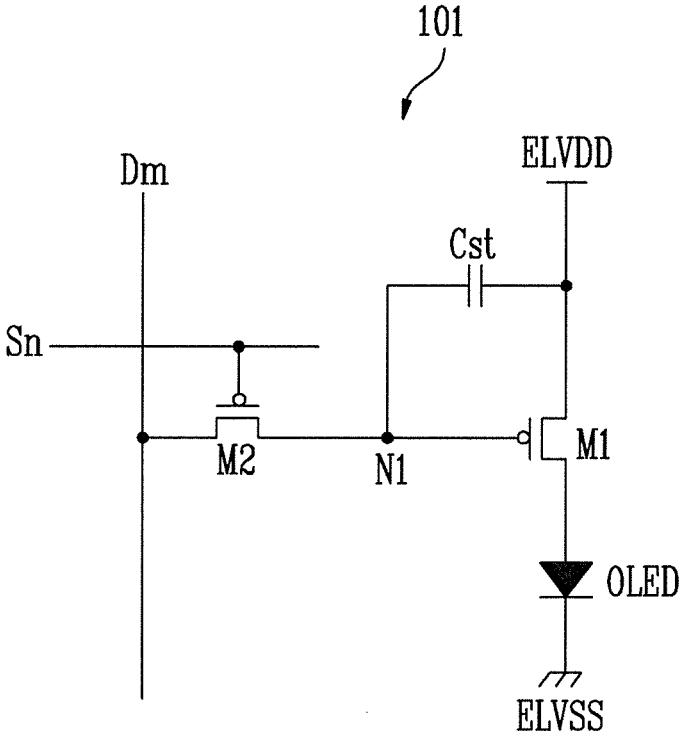
FIG. 4 is a circuit diagram illustrating a pixel adopted by the organic light emitting display of FIG. 2.

FIG. 4 is a circuit diagram illustrating a pixel adopted by the organic light emitting display of FIG. 2. Referring to FIG. 4, the pixel 101 includes a first transistor M1, a second transistor M2, a capacitor Cst, and an organic light emitting diode (OLED) and receives a data signal and a scan signal through the data line Dm and the scan line Sn.

The source of the first transistor M1 is coupled to the first power source ELVDD. The drain of the first transistor M1 is coupled to the anode electrode of the OLED. The gate of the first transistor M1 is coupled to a first node N1. Therefore, the amount of the current that flows from the source to the drain is determined to correspond to the voltage of the first node N1.

The source of the second transistor M2 is coupled to the data line Dm. The drain of the second transistor M2 is coupled to the first node N1. The gate of the second transistor M2 is coupled to the scan line Sn. Therefore, the data signal transmitted through the data line Dm to correspond to the scan signal transmitted through the scan line Sn can be transmitted to the first node N1.

The first electrode of the capacitor Cst is coupled to the first power source ELVDD and the second electrode of the capacitor Cst is coupled to the first node N1. Therefore, the voltage of the first node N1 can be maintained.

The anode electrode of the OLED is coupled to the drain of the first transistor M1. The cathode electrode of the OLED is coupled to the second power source ELVSS. A light emitting layer is formed between the anode electrode and the cathode electrode. Light is emitted to correspond to the current that flows from the anode electrode to the cathode electrode. Therefore, light is emitted to correspond to the amount of current that flows from the source of the first transistor M1 to the drain of the first transistor M1.

Figure 5:
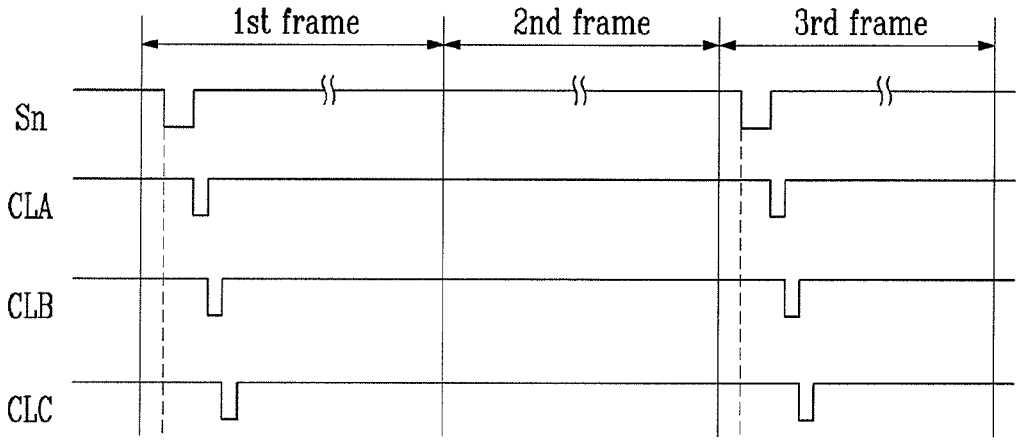
FIG. 5 is a waveform diagram illustrating scan signals and demultiplexer control signals input to the organic light emitting display of FIG. 2.

FIG. 5 is a waveform diagram illustrating scan signals and demultiplexer control signals input to the organic light emitting display of FIG. 2. Referring to FIG. 5, the image displayed by the pixel unit 100 of the organic light emitting display is displayed by utilizing a plurality of frames.

First, in a first frame period, the scan signal Sn and demultiplexer control signals are transmitted. Therefore, the data signals output from the data driver 200 by the demultiplexer control signals CLA, CLB, and CLC are sequentially distributed to the data lines. Then, the data signal is transmitted to a specific pixel 101 by the scan signal Sn and the pixel 101 emits light to correspond to the data signal. Therefore, an image (a standby image) is displayed on the display region 120 of the pixel unit 100.

The scan signal Sn and the demultiplexer control signals CLA, CLB, and CLC are not transmitted in a second frame period (e.g., an adjacent frame following the first frame). Therefore, the data signals corresponding to the second frame are not transmitted to the pixel 101. However, since the data signals transmitted in the first frame period are previously stored in the capacitor Cst in the pixel 101, the same image as the image of the first frame is displayed in the second frame.

Then, in a third frame period (e.g., an adjacent frame following the second frame), the scan signal Sn and the demultiplexer control signals CLA, CLB, and CLC are transmitted. At this time, light is emitted from the pixel 101 in accordance with (to correspond to) the transmitted data signals.

Therefore, the scan signal Sn is not transmitted in the second frame period since the scan driver 300 is not driven. Therefore, power consumption utilized by the scan driver 300 can be reduced by the stopping of driving of the scan driver 300. In addition, since the icons displayed in the standby mode are images that do not frequently change, although the data signals are not received during all of the frames, it is still possible to reduce or prevent the images from being distorted or wrongly transmitted.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

a pixel unit for displaying an image by utilizing a plurality of frames and in accordance with data signals and scan signals, the pixel unit having a first display region and a second display region;

a data driver for outputting the data signals;

a scan driver for outputting the scan signals; and a controller for controlling the data driver and the scan driver so that, in at least one entire frame of the plurality of frames, data signals stored in the pixel unit during a previous frame of the plurality of frames are used to display the image in the second display region while the scan driver does not transmit any of the scan signals to the pixel unit.

2. The organic light emitting display as claimed in claim 1, wherein the scan driver is stopped from being driven to output the scan signals by the controller during the at least one entire frame when the scan signals are not transmitted.

3. The organic light emitting display as claimed in claim 1, further comprising a demultiplexer between the data driver and the pixel unit to distribute a plurality of data signals output from one output end of the data driver during a frame period of at least an other frame of the plurality of frames.

4. The organic light emitting display as claimed in claim 3, wherein an operation of the demultiplexer stops in the at least one entire frame when the scan signals are not transmitted to the pixel unit.

5. The organic light emitting display as claimed in claim 1, wherein the image is displayed only in the second display region of the pixel unit.

6. The organic light emitting display as claimed in claim 1, wherein the image is a standby image.

7. A method of driving an organic light emitting display for displaying an image by utilizing a plurality of frames and in accordance with data signals and scan signals, comprising:

transmitting the data signals to pixels of a pixel unit of the organic light emitting display by the scan signals to display a first image of a first frame of the plurality of frames, the pixel unit having a first display region and a second display region; and maintaining the data signals transmitted in the first frame in the pixels to display a second image of a second frame of the plurality of frames without transmitting any of the scan signals to the pixels during an entire duration of the second frame, wherein the first image and the second image are same images.

8. The method as claimed in claim 7, wherein the first and second images are displayed only on the second display region of the pixel unit.

9. The method as claimed in claim 8, wherein the first and second images are a standby image.

10. The method as claimed in claim 7, wherein the second frame is an adjacent frame following the first frame.

11. An organic light emitting display, comprising:

a pixel unit for displaying an image by utilizing a plurality of frames and in accordance with data signals and scan signals, the pixel unit having a first display region and a second display region;

a data driver for outputting the data signals;

a scan driver for outputting the scan signals; and a controller configured to control the data driver and the scan driver to transmit the data signals to the pixel unit in a first frame of the plurality of frames to display a first image in the second display region, and to display the first image in the second display region using data signals stored in the pixel unit during a second frame while the scan driver does not transmit any of the scan signals during an entire duration of the second frame of the plurality of frames.

12. The organic light emitting display as claimed in claim 11, wherein, in the second frame, the pixel unit is adapted to maintain the data signals transmitted in the first frame to display a second image of the second frame.

13. The organic light emitting display as claimed in claim 12, wherein the data driver is configured to not transmit the data signals in the second frame.

14. The organic light emitting display as claimed in claim 12, wherein the first and second images are displayed only in the second display region of the pixel unit.

15. The organic light emitting display as claimed in claim 12, wherein the first and second images are a standby image.

16. The organic light emitting display as claimed in claim 12, wherein the second frame is an adjacent frame following the first frame.

17. The organic light emitting display as claimed in claim 11, wherein the first image is displayed only in the second display region of the pixel unit.

18. The organic light emitting display as claimed in claim 11, wherein the first image is a standby image.

* * * * *